US012723471B2

(12) United States Patent
Richards et al.

(10) Patent No.: US 12,723,471 B2
(45) Date of Patent: Sep. 1, 2026

(54) SYSTEMS AND METHODS FOR STEERING A DOWNHOLE TOOL

(71) Applicant: Schlumberger Technology Corporation, Sugar Land, TX (US)

(72) Inventors: Edward Richards, Stonehouse (GB); Blaine Dow, Sugar Land, TX (US); Jean-Marie Degrange, Sugar Land, TX (US); Sonu Poulo Jose, Stonehouse (GB); Edward George Parkin, Stonehouse (GB); Stephen Louks, Stonehouse (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/046,840

(22) Filed: Feb. 6, 2025

(65) Prior Publication Data

US 2026/0226797 A1 Aug. 6, 2026

(51) Int. Cl.
*E21B 7/04* (2006.01)

(52) U.S. Cl.
CPC ..... *E21B 7/04* (2013.01)

(58) Field of Classification Search
CPC ..... E21B 7/04; E21B 7/06
See application file for complete search history.

(56) References Cited

U.S. PATENT DOCUMENTS

| | | | | |
|---|---|---|---|---|
| 6,681,853 | B2 | 1/2004 | Doyle | |
| 7,222,668 | B2 | 5/2007 | Champ | |
| 2008/0000693 | A1* | 1/2008 | Hutton | E21B 7/064 175/73 |
| 2011/0031025 | A1* | 2/2011 | Kulkarni | E21B 7/064 175/61 |
| 2012/0118643 | A1 | 5/2012 | Neves | |
| 2019/0128071 | A1* | 5/2019 | Conger | E21B 34/06 |
| 2021/0087885 | A1* | 3/2021 | Chambers | E21B 7/061 |
| 2021/0340820 | A1* | 11/2021 | Hagar | E21B 17/1014 |

FOREIGN PATENT DOCUMENTS

| | | | | |
|---|---|---|---|---|
| CN | 109519128 B | * | 2/2024 | E21B 10/46 |
| WO | 0131162 A1 | | 5/2001 | |

* cited by examiner

*Primary Examiner* — Dany E Akakpo
(74) *Attorney, Agent, or Firm* — Jeffrey D. Frantz

(57) ABSTRACT

A device may include a body having a rotational axis. A device may include a steering pad, the steering pad being movable radially outward relative to the body at a hinge. A device may include a bore formed in the body, the bore having a bore longitudinal axis that is at least partially radially relative to the rotational axis of the body. A device may include a piston in the bore and movable in the bore to apply a radially outward force to the steering pad.

20 Claims, 10 Drawing Sheets

SYSTEMS AND METHODS FOR STEERING A DOWNHOLE TOOL

BACKGROUND

For drilling of a borehole, directional drilling allows creation of a non-linear borehole or a linear borehole through varying earth formations. Directional drilling units contain actuatable pads to apply lateral forces and steer a bit.

SUMMARY

In some aspects, the techniques described herein relate to a device for steering a downhole tool, the device including: a body having a rotational axis; a steering pad, the steering pad being movable radially outward relative to the body at a hinge; a bore formed in the body, the bore having a bore longitudinal axis that is at least partially radially relative to the rotational axis of the body; and a piston in the bore and movable in the bore to apply a radially outward force to the steering pad.

In some aspects, the techniques described herein relate to a system for steering a downhole tool, the system including: a body having a rotational axis; at least two steering assemblies positioned angularly around the body, wherein each steering assembly includes: a steering pad, the steering pad being movable radially outward relative to the body at a hinge, a bore formed in the body, the bore having a bore longitudinal axis that is at least partially radially relative to the rotational axis of the body, a piston in the bore and movable in the bore to apply a radially outward force to the steering pad; and a central flow bore in the body oriented in an axial direction of the rotational axis, the central flow bore having a transverse cross-section that is non-circular and having at least one apex angularly between the at least two steering assemblies.

In some aspects, the techniques described herein relate to a method of manufacturing a steering tool, the method including: forming a body with an integrally formed bore therein; heating the body to expand a diameter of the bore; inserting a sleeve into the bore; and cooling the body to contract a wall of the bore around the sleeve.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which:

FIG. 5-1 and FIG. 5-2 illustrate a steering tool with a hinge plate and integrated bores, according to at least some embodiments of the present disclosure.

DETAILED DESCRIPTION

Embodiments of the present disclosure generally relate to devices, systems, and methods for steering a downhole tool in a downhole environment. More particularly, devices, systems, and methods according to the present disclosure may allow for a more robust and durable steering tool. In some examples, devices, systems, and methods according to the present disclosure may allow for a steering tool with greater range of motion and/or capable of a smaller turning radius in the downhole formation.

In some embodiments, a steering tool according to the present disclosure includes one or more of an integrally formed bore, an integrally formed portion of a hinge, and a non-circular central flow bore. One or more of the integrally formed bore, the integrally formed portion of a hinge, and the non-circular central flow bore allows for a stronger body of a steering tool. The stronger body may allow for a larger bore (in length and/or diameter) and a longer range of motion of a movable pad relative to the body. In some embodiments, the one or more of an integrally formed bore, an integrally formed portion of a hinge, and a non-circular central flow bore reduces cracking and/or erosion of the body, further increasing an operational lifetime of the steering tool.

Figure 1:
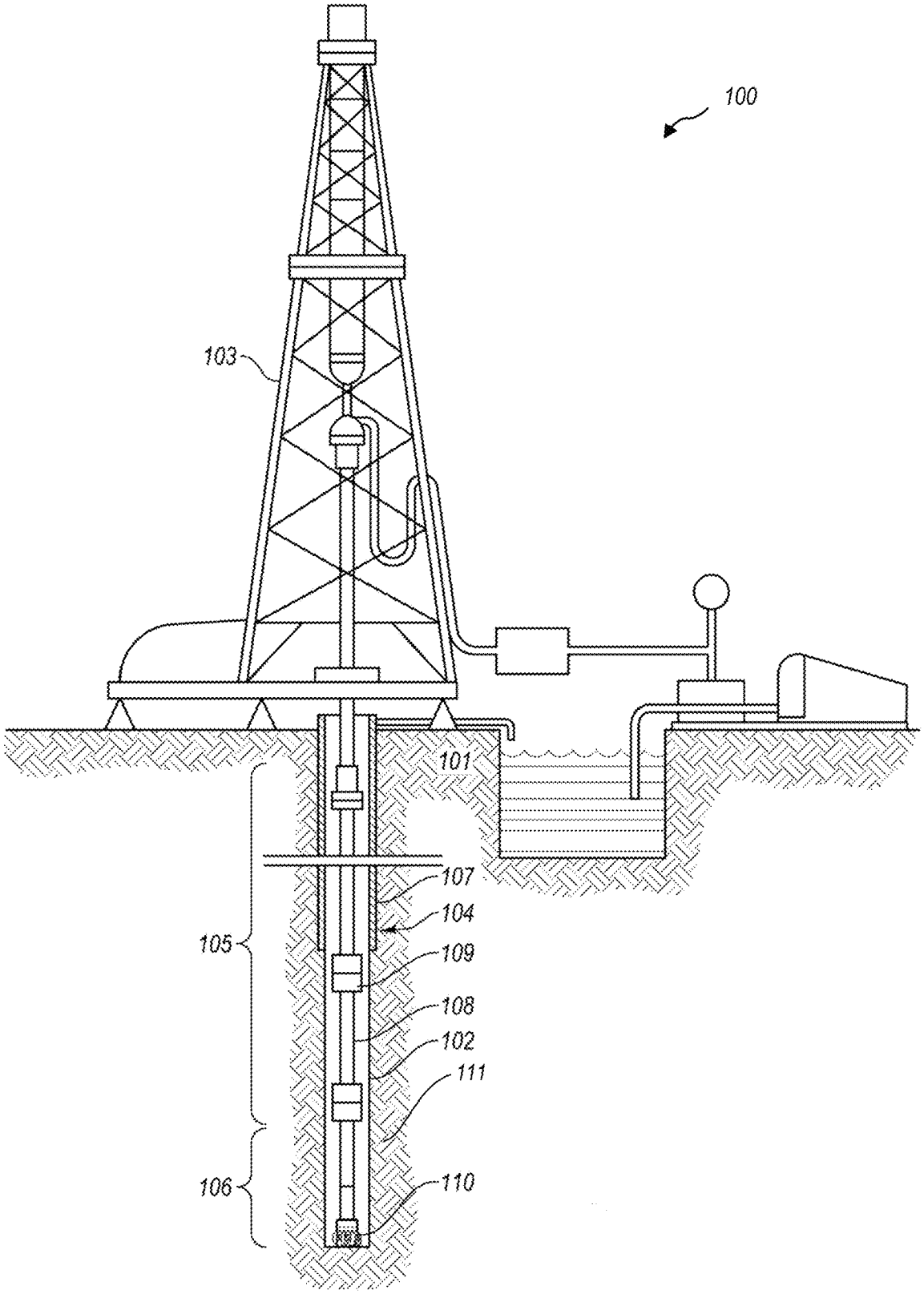
FIG. 1 illustrates a drilling system and downhole environment, according to some embodiments of the present disclosure.

FIG. 1 illustrates an embodiment of a drilling system and downhole environment. FIG. 1 shows one example of a drilling system 100 for drilling an earth formation 101 to form a borehole 102. The drilling system 100 includes a drill rig 103 used to turn a drilling assembly 104 which extends downward into the borehole 102. The drilling assembly 104 may include a drill string 105 and a bottomhole assembly (BHA) 106 attached to the downhole end of the drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the borehole 102 as it is being drilled, and for preventing the collapse of the borehole 102. The drilling fluid 111 carries drill solids including drill fines, drill cuttings, and other swarf from the borehole 102 to the surface based on a hydrostatic pressure of the borehole 102. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the borehole 102. The bit 110 may also be a junk mill used to mill away tools, plugs, cement, other materials within the borehole 102, or combinations thereof. Swarf or other cuttings formed by use of a mill may be lifted to surface by the drilling fluid 111 or may be allowed to fall downhole. The conditions of the equipment of the drilling system 100, the formation 101, the borehole 102, the drilling fluid 111, or other part of the wellsite can change during operations.

Figure 2:
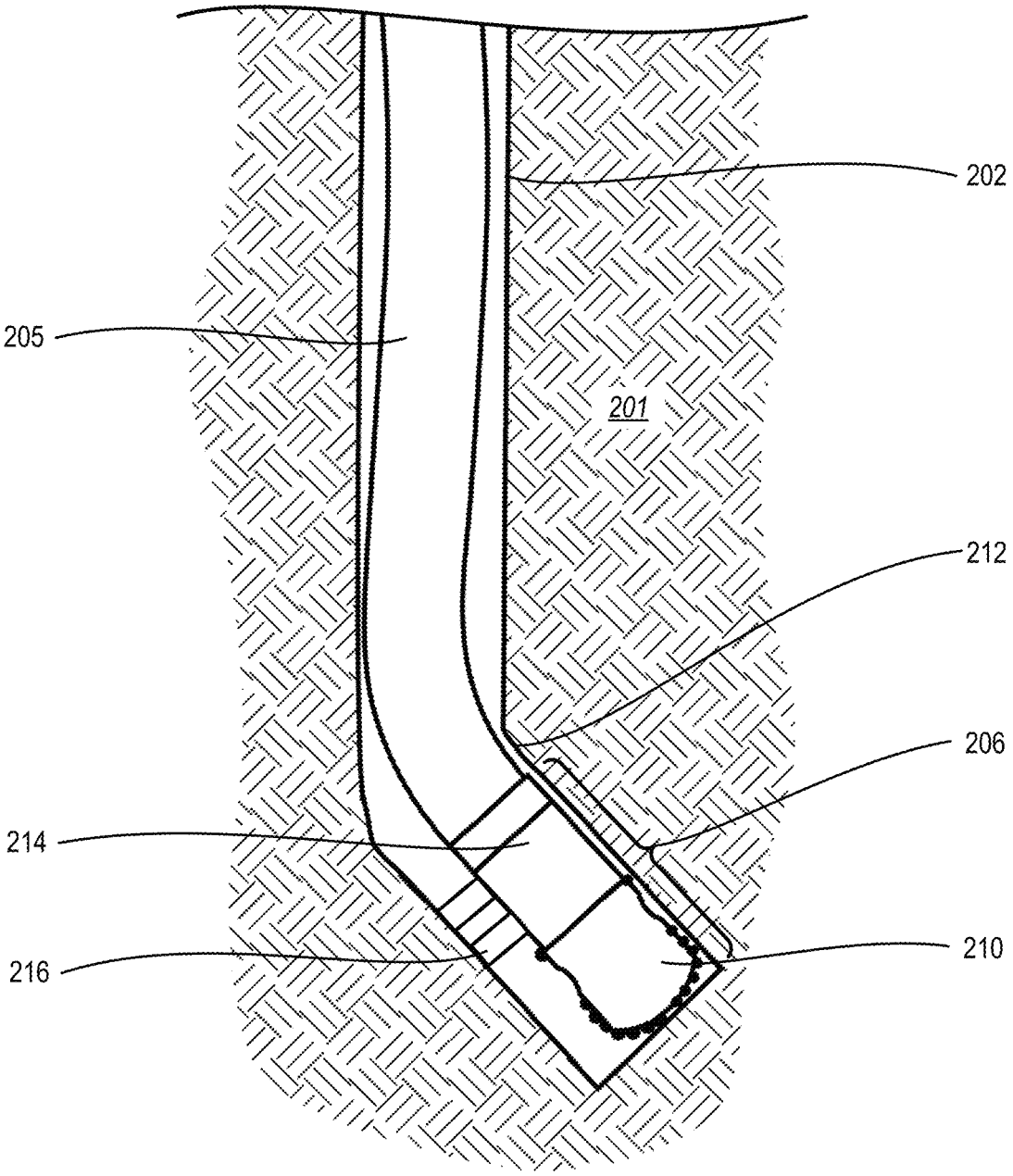
FIG. 2 is a side view of an embodiment of a downhole environment in which a bottomhole assembly and drill string steer the bit to create a curve of a borehole.

In some embodiments, the BHA 106 includes one or more biasing units that allow an operator to steer the bit 110 relative to the earth formation 101 as the drilling assembly 104 rotates in the borehole 102. For example, FIG. 2 is a side view of an embodiment of a downhole environment in which a BHA 206 and drill string 205 steer the bit 210 to create a curve of a borehole 202.

In some embodiments, a portion of the BHA 206 and/or drill string 205 contacts a radially inward surface 212 of the borehole 202 as the BHA 206 and drill string 205 follow the curve. In some embodiments, when the BHA 206 and drill string 205 contact the formation 201 of the borehole surface, the BHA 206 and drill string 205 experience damage from the formation 201. In some embodiments, when the BHA 206 and drill string 205 contact the formation 201 of the borehole surface, the BHA 206 and drill string 205 experience drag, in the longitudinal direction and/or the rotational direction, placing additional strain on the drilling system and components thereof. Precise control of steering the BHA 206 and the bit 210 with a directional steering tool 214 allows the drilling system to limit and/or prevent damage to the BHA 206 and drill string 205 in non-linear boreholes 202.

In some embodiments, a directional steering tool 214 is a discrete steering tool that is coupled to a drill bit 210. In some embodiments, the directional steering tool 214 is the drill bit with an integrated biasing element or steering element. For example, a directional steering tool 214 includes at least one movable pad 216 configured to actuate radially outward from a rotational axis of the BHA 206 and drill string 205. As the BHA 206 and drill string 205 rotate, the movable pad 216 is actuated between a closed position and an open position to selectively apply a lateral force to the borehole wall. The drill bit 210 is urged in an opposing lateral direction to steer the drill bit 210 and the direction of the borehole 202.

In some embodiments, an MWD unit allows for measurements of a plurality of operating conditions, environmental conditions, fluid measurements, or other status information regarding the performance and/or condition of the downhole tool and the downhole environment in which the downhole tool is operating. In some embodiments, the MWD unit measures and/or records directional information of the downhole tool. In some examples, the MWD unit includes accelerometers and/or magnetometers to measure the inclination and azimuth of the borehole at the measured location. In some embodiments, the MWD unit includes survey gyroscopes that allow directional and/or movement information, such as inclination, azimuth, velocity, and other values. In some embodiments, the MWD unit records the directional measurements. In some embodiments, the MWD unit transmits the measurements to a system and/or operator at the surface.

In some embodiments, the MWD unit measures and/or records drilling mechanics information. In some embodiments, the drilling mechanics information includes a rotational speed of the drill string; variation (vibration) in the rotational speed; amplitude, frequency, and mode of vibrations of the drill string; downhole temperature; torque on bit; weight on bit; mud flow volume; other drilling mechanics information; and combinations thereof. In some embodiments, the MWD unit records the drilling mechanics information. In some embodiments, the MWD unit transmits the drilling mechanics information to a system and/or operator at the surface.

Figure 3:
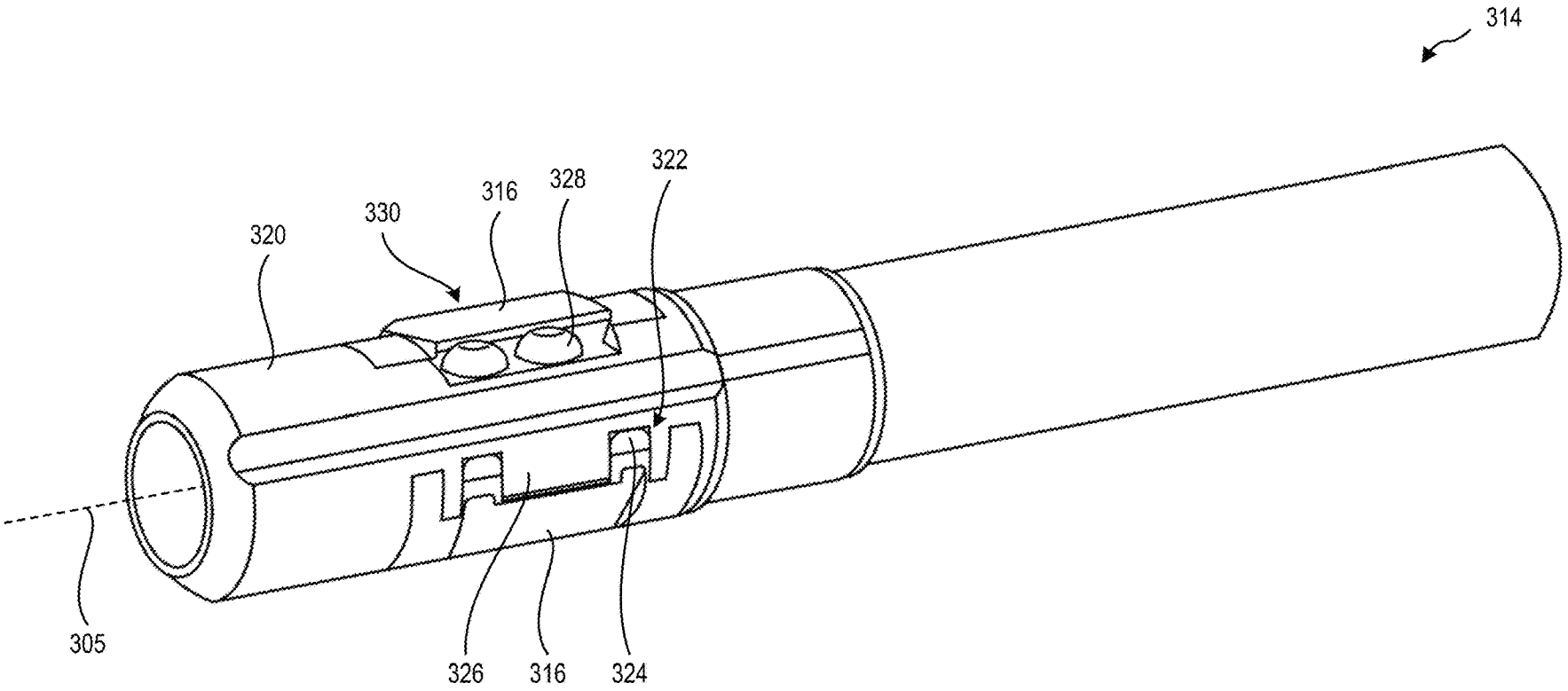
FIG. 3 is a perspective view of a directional steering tool including a plurality of movable pads, according to at least some embodiments of the present disclosure.

FIG. 3 is a perspective view of an embodiment of a directional steering tool 314 including a plurality of movable pads 316. In some embodiments, the steering tool 314 includes a body 320. In some embodiments, the body 320 is a monolithic body that is a continuous piece of metal, ceramic, or other material. In some examples, any features integrally formed in or from the body are machined from the continuous billet of material. In some examples, any features integrally formed in or from the body are cast in the continuous piece of material. For example, the body 320 may include a central lug 326 of a hinge 322 to which the arms 324 of a movable pad 316 are rotatably connected to the body 320. In such an example, the portion of the hinge 322 included in the body 320 is integrally formed with and/or from the continuous piece of material that forms the body 320, as well.

The directional steering tool 314, in some embodiments, includes a plurality of steering assemblies 330 that each include at least one piston 328 located in a bore (not shown in FIG. 3), where the bore is integrally formed with the body 320 of the directional steering tool 314. In some embodiments, the piston 328 is movable in a radial direction (either directly radially or angled to a radial direction with a radial component) relative to the rotational axis 305 of the body 320 to urge the movable pad 316 in the radially outward direction. In some embodiments, the piston 328 is coupled or connected to the movable pad 316 to also apply a radially inward force to retract the movable pad 316. In some embodiments, the piston 328 is not coupled to the movable pad 316, but rather a separate biasing element (such as a spring in the hinge 322) applies a biasing force to restore the movable pad 316 radially inward in the absence or reduction of the radially outward force from the piston. In some embodiments, the piston 328 is not coupled to the movable pad 316, but rather a static pressure in the wellbore and/or contact with a wellbore wall applies a radially inward force to restore the movable pad 316 radially inward in the absence or reduction of the radially outward force from the piston.

In some embodiments according to the present disclosure, a hinge that is at least partially integrally formed with the body 320 and/or a bore that is integrally formed with the body 320 allows the body 320 to be stiffer and/or the movable pad 316 to have a larger range of motion in a radial direction.

Figure 4:
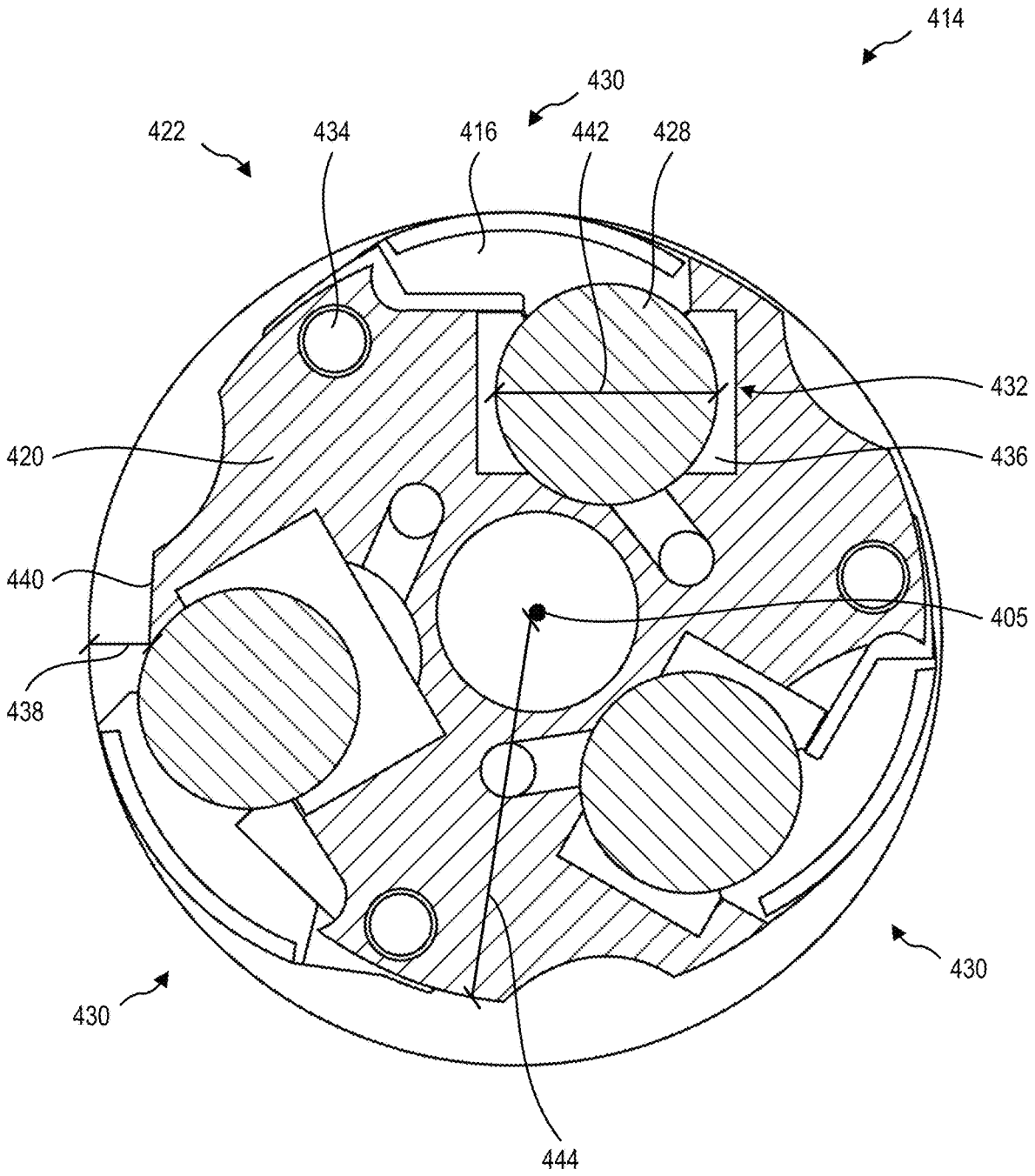
FIG. 4 is a transverse cross-sectional view of a steering tool with an integrally formed hinge and integrally formed bores, according to at least some embodiments of the present disclosure.

FIG. 4 is a transverse cross-sectional view of an embodiment of a steering tool 414 with a integrally formed hinge 422 integrated with the body 420 and integrally formed bores 432 in the body 420. In a conventional steering tool, a cavity is formed (either cast or machined) in the outer surface of the body to receive a clamp plate that carries the steering assembly. The large cavity creates a weaker body 420 in torsion (a common force applied to the directional steering tool) that causes the body 420 to flex under load and leak around the edges of the seals of the clamp plate. In some embodiments, an integrally formed hinge 422 allows a portion of the hinge 422 to remain integrally formed with the body 420 and provide additional strength to the body 420. Further, integrally forming the bore(s) 432 in the body 420 allows the material of the bore walls to remain integrally formed with the body 420 and provide additional strength to the body 420. Ultimately, this allows the bore to be larger with a longer stroke and larger range of motion for the movable pad 416. In some embodiments, a hinge 422 that is partially integrally formed with the body 420 allows a hinge pin 434 to be located through a portion of the body 420 and a portion of the movable pad 416 providing additional strength to the body 420 and limiting relative movement of the body 420 and the movable pad 416 (which can produce binding) during torsional flexion of the steering tool 414.

In some embodiments, the bore 432 is integrally formed in the body 420, and the body material is not a desired material for the bore wall. In such embodiments, the bore 432 has a sleeve 436 positioned therein, wherein the sleeve 436 includes or is made of a different material from the bore 432. In some embodiments, the sleeve 436 is or includes the same material but machined to a higher tolerance than the bore 432 is formed in the body 420. In some embodiments, the sleeve 436 includes or is made of a harder and/or tougher material than the body material to withstand the wear and/or erosion of the piston 428 and a piston fluid repeatedly moving in the sleeve 436. In some embodiments, the piston 428 includes or is made of a piston material that is metallurgically incompatible with the body material (such as polycrystalline diamond piston and a steel body), and the sleeve 436.

In some embodiments, bore 432 has a substantially constant inner diameter along the length of the bore 432, and the sleeve 436 has a substantially uniform sleeve thickness along the length of the sleeve 436. In some embodiments, the sleeve 436 is press-fit or friction-fit into the bore 432. In some embodiments, at least a portion of the bore wall tapers (i.e., an inner diameter of the bore 432 decreases) toward a radially outward end of the bore 432, and the sleeve 436 has a sleeve thickness that decreases toward the radially outward end of the bore 432 such that an inner diameter of the sleeve 436 is substantially constant along a length of the sleeve 436. In some embodiments, the body 420 of the steering tool 414 is heated prior to insertion of the sleeve 436 to expand an inner diameter of the bore 432 and heat-shrink the bore 432 to the sleeve 436 after insertion. In some embodiments, the sleeve is cooled (such as via liquid nitrogen) to contract the sleeve prior to insertion of the sleeve 436, after which the thermal expansion of the sleeve 436 compresses the sleeve 436 against the wall of the bore 432. In some embodiments, both the body 420 is heated and the sleeve 436 is chilled before insertion of the sleeve 436 in the bore 432.

In some embodiments, the piston 428 is a substantially spherical piston 428. In some examples, a spherical piston 428 may limit binding of the piston 428 in the bore 432 and/or sleeve 436. In some embodiments, a height of the spherical piston 428 above the body at the top of its travel in the bore 432 and/or sleeve 436 is based upon a radius of the piston 428. As described herein, a bore 432 (and/or a hinge) that is integrally formed with the body 420 allows for a larger bore 432 while the body 420 remains as strong or stronger than a conventional steering tool with a clamp plate assembly. A larger bore diameter allows a larger spherical piston diameter, and a larger spherical piston diameter allows for a greater radial deployment and/or greater range of motion 438 of the movable pad 416 relative to the outer surface 440 of the body 420.

In some embodiments, a spherical piston diameter 442 is at least 35% of a radius 444 of the body 420 (from the rotational axis 405 to the outer surface 440). In some embodiments, a spherical piston diameter 442 is at least 45% of a radius 444 of the body 420. In some embodiments, a spherical piston diameter 442 is at least 50% of a radius 444 of the body 420. In a non-limiting example, a steering tool 414 with a 4-inch (101.2-mm) radius 444 has at least one spherical piston 428 with a piston diameter 442 of 40 mm.

In such embodiments, the range of motion 438 is greater than a conventional steering tool with smaller bore(s) and piston(s).

Figures 1, 5:
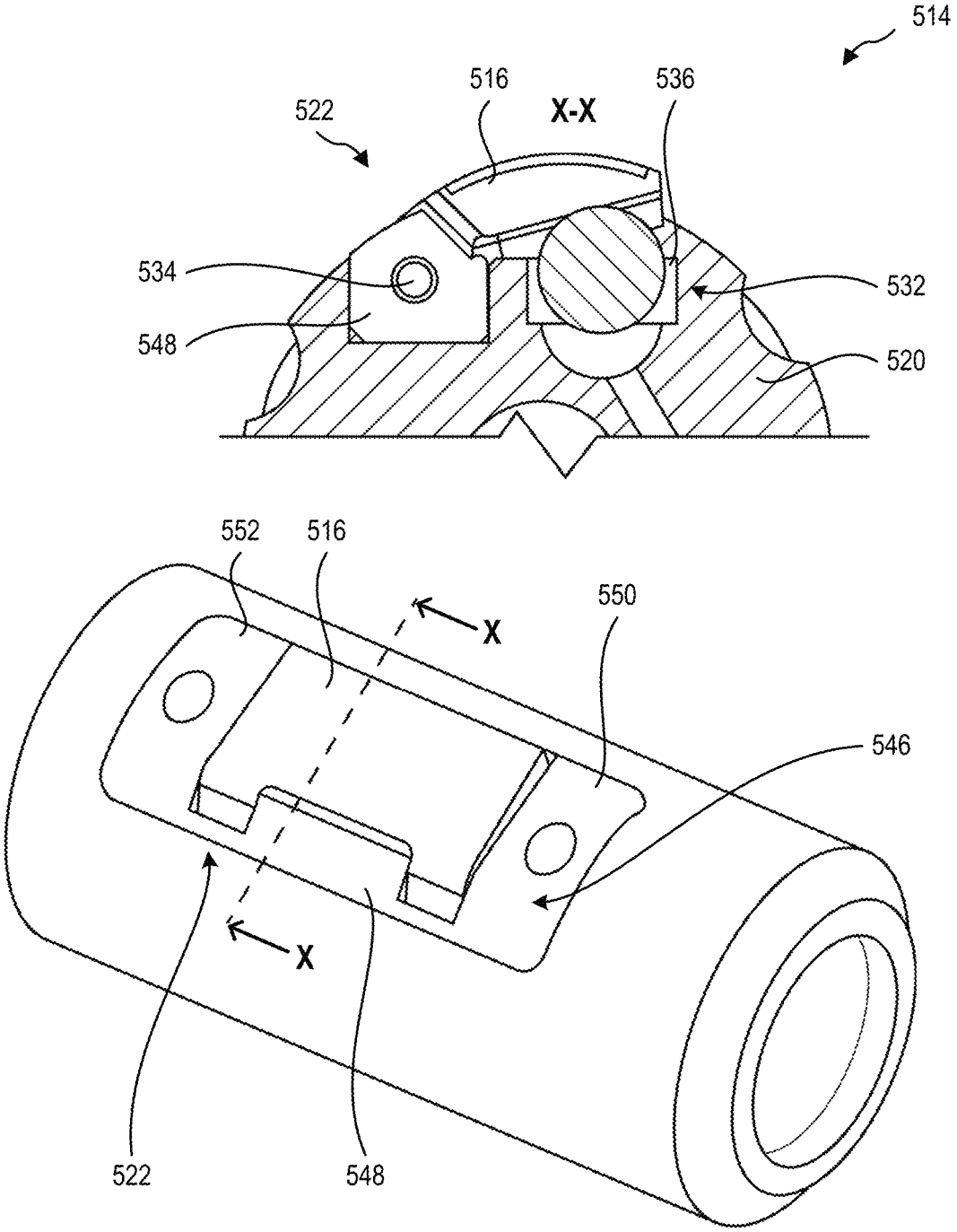
Figures 2, 5:
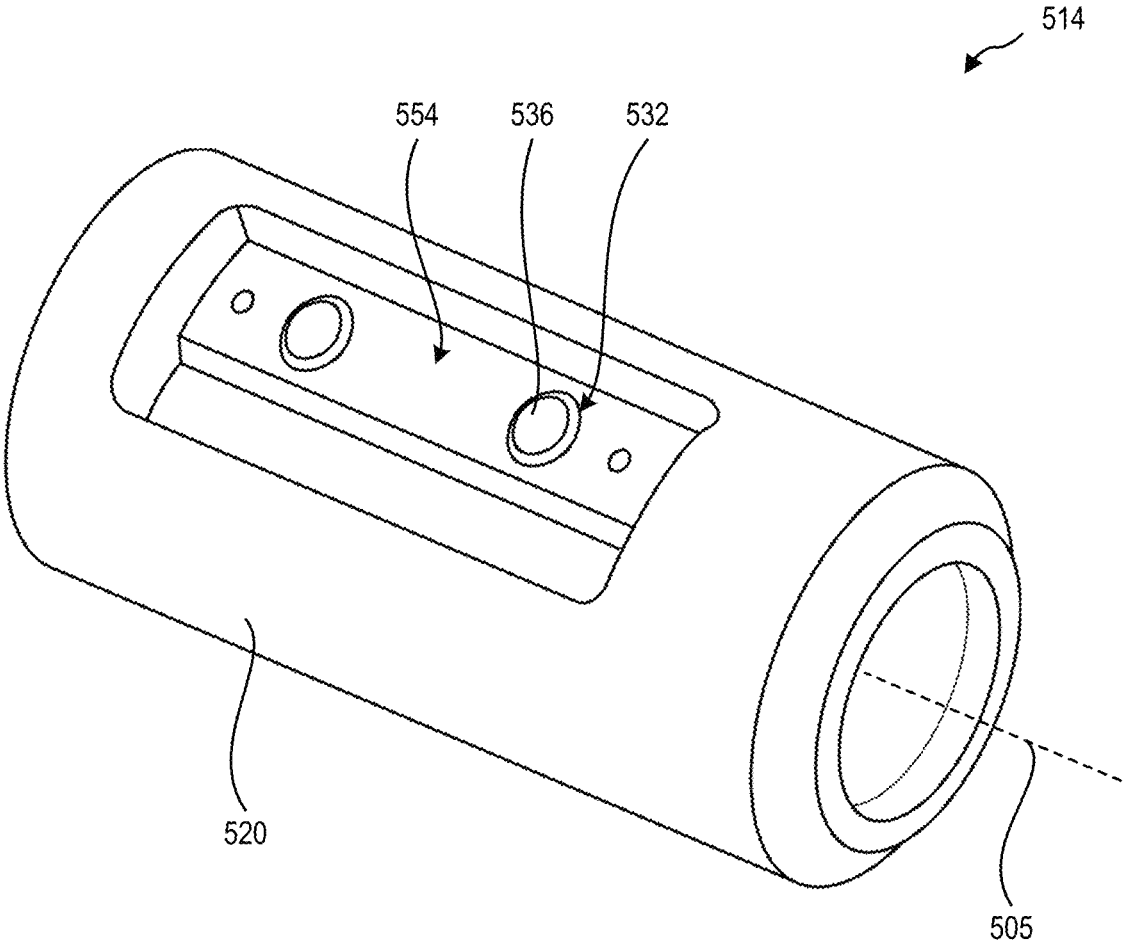

FIG. 5-1 is a perspective view of an embodiment of a steering tool 514 and cross-section (X-X) of the steering tool 514. In some embodiments, the steering tool 514 has integrally formed bores 532 in the body 520. In some embodiments, the steering tool 514 has a hinge 522 that couples the movable pad 516 to a hinge plate 546. The hinge plate 546 incorporates a central lug 548 with one or both of a lower kicker 550 and an upper kicker 552. The hinge plate 546 allows a hinge pin 534 to be inserted into the hinge plate 546 to connect the movable pad 516 to the hinge plate 546. Upon insertion of the hinge plate 546 into the body 520 of the steering tool 514, the hinge pin 534 becomes axially captured in the hinge plate 546. In some embodiments, the integrally formed bores 532 allow the body 520 to maintain a strength and/or rigidity greater than that of a conventional steering tool with a clamp plate, while the hinge plate 546 provides an ease of assembly and/or repair for the hinge 522.

For example, FIG. 5-2 is a perspective view of the embodiment of a steering tool 514 of FIG. 5-1 with the movable pad (i.e., movable pad 516) and hinge plate (i.e., hinge plate 546) removed to expose the bores 532 and the sleeves 536. In some embodiments, the radially outward ends of the bores 532 terminate at a support surface 554. The support surface 554 is configured to support the movable pad when in a radially inboard position. In some embodiments, the support surface 554 is substantially continuous between the radially outward ends of the bores 532. For example, a substantially continuous support surface 554 has a substantially constant radius relative to the rotational axis 505 of the steering tool 514 between the radially outward ends of the bores 532. For example, a substantially continuous support surface 554 is substantially flat and linear in a longitudinal direction of the support surface 554 between the radially outward ends of the bores 532. In some embodiments, a substantially continuous support surface 554 is monolithic between the radially outward ends of the bores 532. In some embodiments, a substantially continuous support surface 554 allows for more material between the bores 532, which provides additional strength and rigidity to the body 520 to reduce flexing relative to the hinge plate. In some embodiments, at least a portion of the hinge is integrally formed with the body to further strengthen the body.

Figure 6:
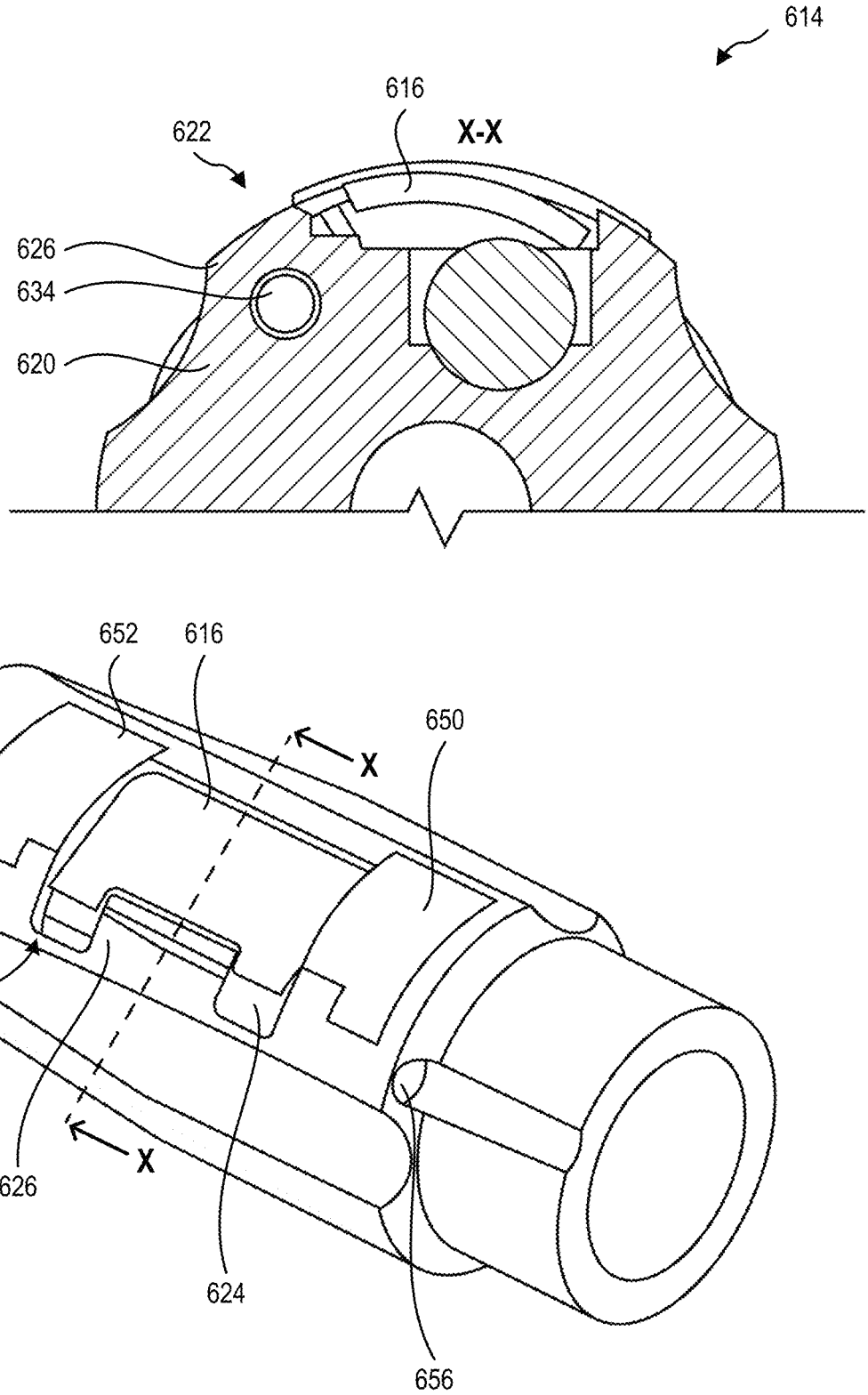
FIG. 6 is a perspective view and cross-sectional view of a steering tool including a central lug of the hinge integrally formed into the body, according to at least some embodiments of the present disclosure.

FIG. 6 is a perspective view of an embodiment of a steering tool 614 and cross-section (X-X) of the steering tool 614 including a central lug 626 of the hinge 622 integrally formed into the body 620. The hinge pin 634 is located through the central lug 626 and couples the central lug 626 to the arm(s) 624 of the movable pad 616 together around the hinge pin 634. In some embodiments, a hinge 622 with a central lug 626 integrally formed with the body 620 includes a discrete lower kicker 650 and/or a discrete upper kicker 652 that are configured to be fastened to the body 620 independently of the hinge 622. In some embodiments, removal of one or both kickers 650, 652 allows insertion or removal of the hinge pin 634 from the hinge 622.

In some embodiments, a hinge 622 with a central lug 626 integrally formed with the body 620 includes a hinge hole 656 that allows the hinge pin 634 to be inserted or removed from the body 620 and/or the hinge 622. For example, the hinge pin 634 may be otherwise entirely captured within the body 620. The hinge hole 656 may provide axial access to the hinge 622 to connect the movable pad 616 to the body 620.

Figure 7:
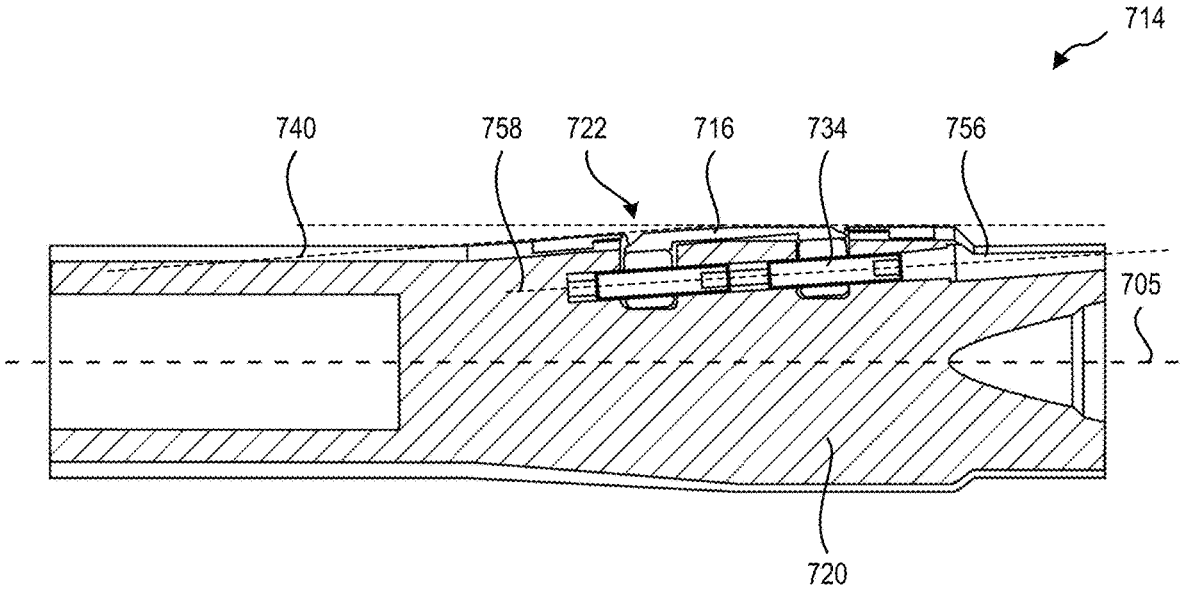
FIG. 7 is a longitudinal cross-sectional view of an embodiment of a steering tool with a hinge at least partially integrally formed with the body, according to at least some embodiments of the present disclosure.

FIG. 7 is a longitudinal cross-sectional view of an embodiment of a steering tool 714 with a hinge 722 at least partially integrally formed with the body 720. In some embodiments, the body 720 has a hinge hole 756 to allow axial access to the hinge pin 734. In some embodiments, a hinge axis 758, the hinge hole 756, and the hinge pin 734 are angled relative to the rotational axis 705 of the steering tool 714 in the radially outward direction. For example, the angled hinge axis 758 allows an angled deployment of the movable pad 716 relative to the outer surface 740 of the body 720 and relative to the rotational axis 705. In some embodiments, an angled hinge hole 756 relative to the rotational axis 705 of the steering tool 714 allows for a shorter hinge hole 756 compared to a hinge hole that is parallel to the rotational axis 705. In some examples, a shorter hinge hole 756 facilitates easier assembly and/or disassembly of the hinge pin 734 in the hinge 722. In some examples, a shorter hinge hole 756 may reduce erosion in the hinge hole 756.

In some embodiments, the body 720 of the steering tool 714 tapers in an uphole direction. For example, the outer diameter of the outer surface 740 of the body 720 decreases in the uphole direction of the steering tool 714 away from the movable pad 716. In some examples, the tapered body 720 reduces the likelihood of contact with the borehole wall and provides additional clearance. In some examples, the tapered body 720 reduces a rigidity of the body 720, rendering additional strength from the integrally formed hinge 722 and/or bores of embodiments of the steering assemblies described herein even more important to the steering tool 714.

Figure 8:
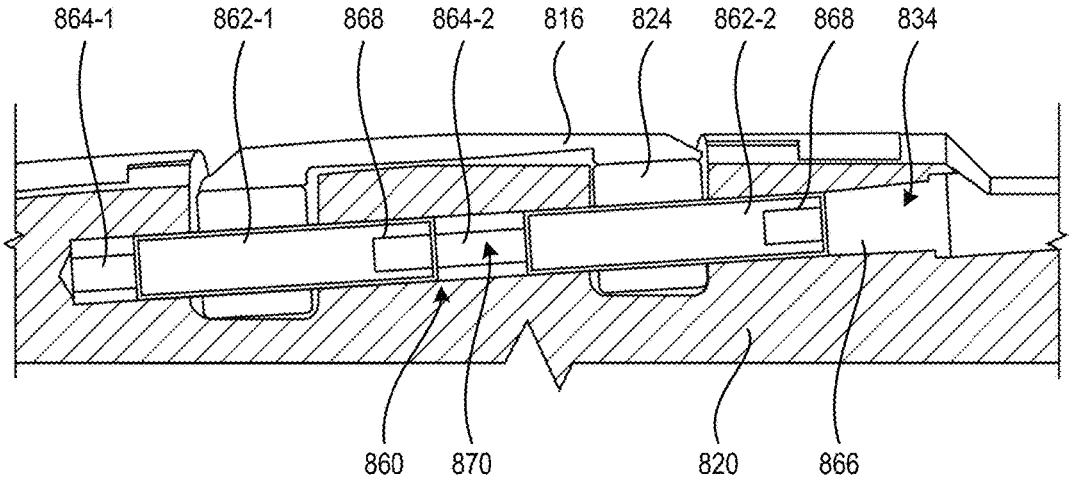
FIG. 8 is a longitudinal cross-sectional view of a segmented hinge pin, according to at least some embodiments of the present disclosure.

Referring now to FIG. 8, in some embodiments, a hinge pin 834 includes a plurality of segments. While FIG. 8 is illustrated as angled hinge pin 834, such as that described in relation to FIG. 7, a segmented hinge pin may be beneficial in other configurations, such as the integrally formed hinge described in relation to FIG. 5 and/or the hinge plate configuration described in relation to FIG. 4. In some embodiments, a segmented hinge pin 834 is modular, allowing segments to be used across multiple steering assembly designs and/or steering tool designs. In some embodiments, a segmented hinge pin 834 is modular, allowing different segments to be replaced individually. In some embodiments, a segmented hinge pin 834 reduces the friction and/or binding of each segment to the hinge bore 860 (e.g., the bore 860 through the movable pad 816 and the body 820 or hinge plate). Segments of shorter length may, therefore, require less force to insert or remove.

In some embodiments, a segmented hinge pin 834 allows individual segments to be inserted individually, reducing the necessary clearance on either end of the hinge bore 860 in the body 820. In some embodiments, the segmented hinge pin 834 includes at least one axle segment 862-1, 862-2 that spans the arm 824 of the movable pad 816 and at least one spacer segment 864-1, 864-2 that positions the at least one axle segment 862-1, 862-2 in the hinge bore 860. The segmented hinge pin 834, in some embodiments, further includes a pin cap 866 that seals and retains the other segments in the hinge bore 860.

In some embodiments, at least one of the segments of the segmented hinge pin 834 includes an axial fastening interface 868. The axial fastening interface 868 allows a tool to be inserted axially into the segment and pulled from the hinge bore 860. For example, an axial fastening interface 868 may include a threaded interface that allows an operator to thread a tool into the axial fastening interface 868 and pull the segment from the hinge bore 860. In some embodiments, at least one segment includes a through bore 870 that allows a tool to pass through the segment and access the axial fastening interface 868 of an adjacent segment.

In the illustrated embodiment of FIG. 8, the segmented hinge pin 834 includes substantially cylindrical segments 862-1, 862-2, 864-1, 864-2 and pin cap 866. In some embodiments, the hinge pin includes non-cylindrical segments. For example, a segmented hinge pin may include spherical axle segments. In some examples, spherical axle segments are anchored by non-spherical segments and/or cylindrical segments. In some embodiments, the spacer segments are made of or include a different material than the axle segments. For example, the axle segments may be made of or include a stronger material than the spacer segments. In some embodiments, the axle segments have a greater thickness or a smaller bore, such that the axle segments are stronger than the spacer segments.

In at least some embodiments according to the present disclosure, an integrally formed hinge and/or an integrally formed bore allows an increased amount of material in the body of the steering tool relative to a conventional steering tool with a clamp plate steering assembly. In some embodiments, a thickness of the body between a central flow bore and a bore of the steering assembly is increased relative to a conventional central flow bore design to further strengthen the body and prevent cracking or erosion between the components.

Figure 9:
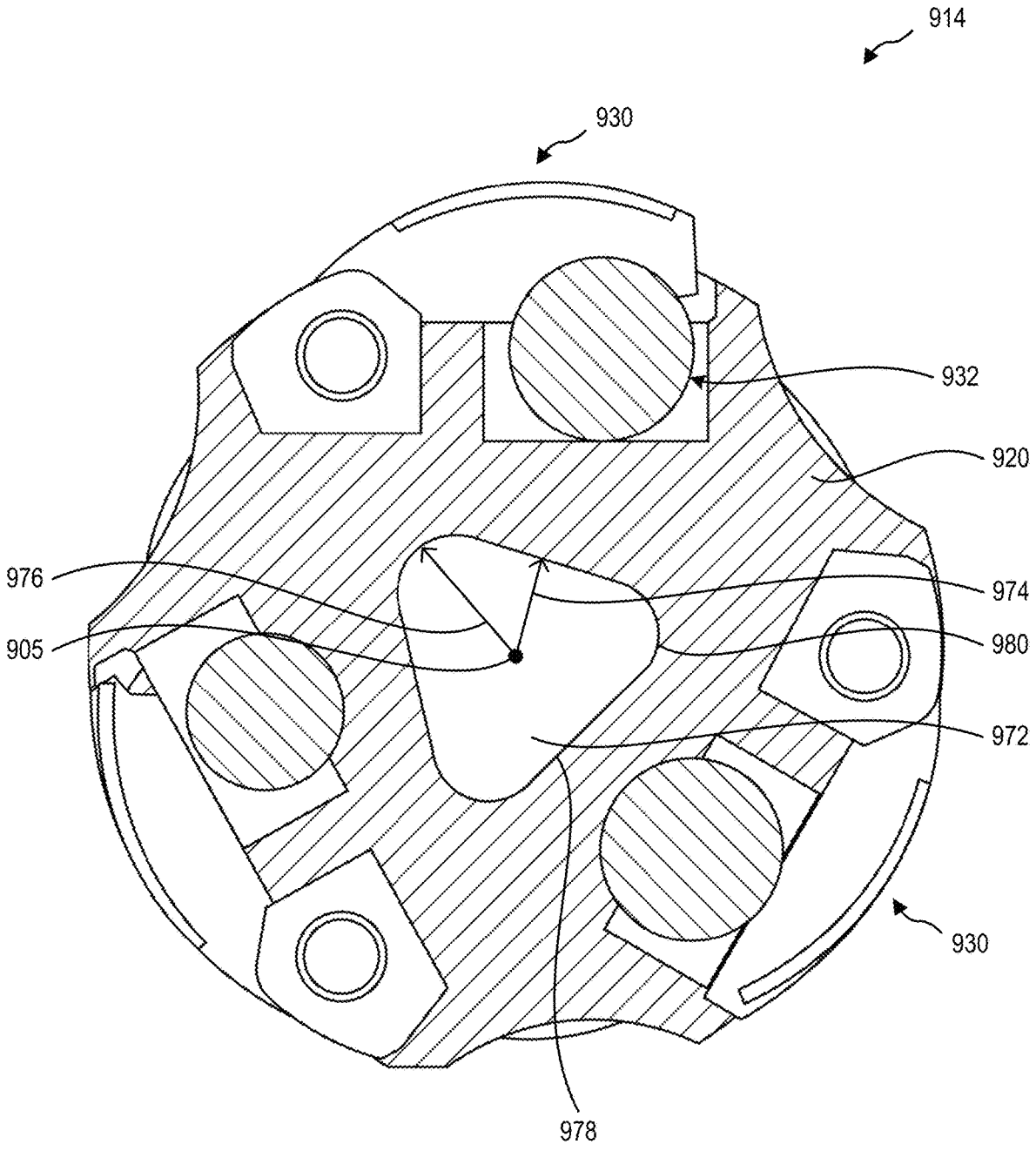
FIG. 9 is a transverse cross-sectional view of a steering tool with a non-circular central flow bore, according to at least some embodiments of the present disclosure.

FIG. 9 is a transverse cross-sectional view of an embodiment of a steering tool 914 with a non-circular central flow bore 972. In some embodiments, a steering tool 914 with a non-circular central flow bore 972 allows for a thicker portion of the body 920 between the radially inward end of the bore(s) 932 of the steering assembly(ies) 930 relative to a conventional circular flow bore and/or a larger cross-sectional area of the central flow bore. A non-circular central flow bore 972 may, therefore, reduce erosion-induced cracking between the central flow bore and the steering assemblies 930.

In some embodiments, the non-circular central flow bore 972 has a portion with a minimum radius 974 and a portion with a maximum radius 976. In some embodiments, the non-circular central flow bore 972 is co-axial with the rotational axis 905 of the steering tool 914, and the minimum radius 974 and the maximum radius 976 are measured from the rotational axis 905. In some embodiments, the non-circular central flow bore 972 is not co-axial with the rotational axis 905 of the steering tool 914, and the minimum radius 974 and the maximum radius 976 are measured from a center axis of the non-circular central flow bore 972.

In some embodiments, a non-circular central flow bore 972 has a plurality of minimum radii 974 at different orientations around the central axis of the non-circular central flow bore 972. For example, the non-circular central flow bore 972 may have a plurality of minimum radii 974 of equal lengths at different orientations around the central axis of the non-circular central flow bore 972. For example, the non-circular central flow bore 972 may have a plurality of local minimum radii 974 of different lengths at different orientations around the central axis of the non-circular central flow bore 972. In some embodiments, a non-circular central flow bore 972 has a plurality of maximum radii 976 at different orientations around the central axis of the non-circular central flow bore 972. For example, the non-circular central flow bore 972 may have a plurality of maximum radii 976 of equal lengths at different orientations around the central axis of the non-circular central flow bore 972. For example, the non-circular central flow bore 972 may have a plurality of local maximum radii 976 of different lengths at different orientations around the central axis of the non-circular central flow bore 972.

In some embodiments, the minimum radius 974 is angularly oriented toward a steering assembly 930 and/or a radially inward end of the bore 932 of the steering assembly 930. In some embodiments, the minimum radius 974 is directed at a flat portion of the cross-sectional shape of the non-circular central flow bore 972. In some embodiments, the maximum radius 976 is angularly oriented between two steering assemblies 930. In some embodiments, the maximum radius 976 is directed at an apex and/or corner of the cross-sectional shape of the non-circular central flow bore 972.

As described herein, some embodiments of a segmented hinge may include non-cylindrical segments.

Figure 10:
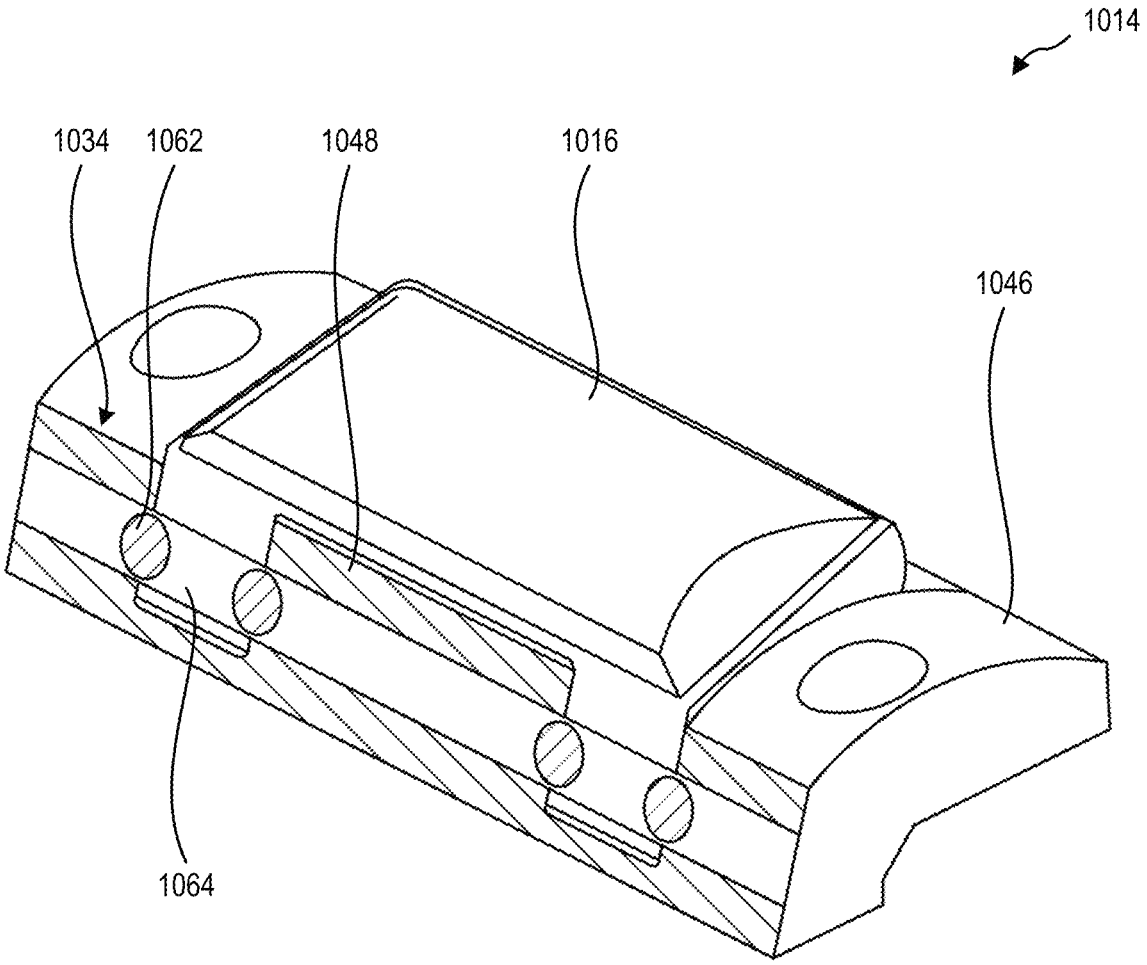
FIG. 10 is a perspective cutaway view of a steering tool with a non-cylindrical hinge segment, according to at least some embodiments of the present disclosure.

FIG. 10 is a perspective cutaway view of an embodiment of a steering tool 1014 with a movable pad 1016 rotatably coupled to a hinge plate 1046 at a hinge. In some embodiments, the hinge includes a segmented hinge pin 1034. For example, the segmented hinge pin 1034 may be installed in the hinge plate 1046 and/or central lug 1048 prior to installation of the hinge in the steering tool 1014. In some embodiments, the segmented hinge pin 1034 includes one or more non-cylindrical axial segments 1062. For example, a spherical, elliptical, or other non-cylindrical axial segments 1062 may be positioned at or near the breaks in the hinge to support the movable pad 1016. In some embodiments, spacer segments 1064 hold the axial segments 1062 in place within the segmented hinge pin 1034.

In at least one embodiment, one or more of an integrally formed bore, an integrally formed portion of a hinge, and a non-circular central flow bore allows for a stronger body of a steering tool. The stronger body may allow for a larger bore (in length and/or diameter) and a longer range of motion of a movable pad relative to the body. In some embodiments, the one or more of an integrally formed bore, an integrally formed portion of a hinge, and a non-circular central flow bore reduces cracking and/or erosion of the body, further increasing an operational lifetime of the steering tool.

Embodiments of the present disclosure generally relate to devices, systems, and methods for steering a downhole tool in a downhole environment. More particularly, devices, systems, and methods according to the present disclosure may allow for a more robust and durable steering tool. In some examples, devices, systems, and methods according to the present disclosure may allow for a steering tool with greater range of motion and/or capable of a smaller turning radius in the downhole formation.

In some embodiments, a steering tool according to the present disclosure includes one or more of an integrally formed bore, an integrally formed portion of a hinge, and a non-circular central flow bore. One or more of the integrally formed bore, the integrally formed portion of a hinge, and the non-circular central flow bore allows for a stronger body of a steering tool. The stronger body may allow for a larger bore (in length and/or diameter) and a longer range of motion of a movable pad relative to the body. In some embodiments, the one or more of an integrally formed bore, an integrally formed portion of a hinge, and a non-circular central flow bore reduces cracking and/or erosion of the body, further increasing an operational lifetime of the steering tool.

In some embodiments, the steering tool includes a body. In some embodiments, the body is a monolithic body that is a continuous piece of metal, ceramic, or other material. In some examples, any features integrally formed in or from the body are machined from the continuous billet of material. In some examples, any features integrally formed in or from the body are cast in the continuous piece of material. For example, the body may include a central lug of a hinge to which the arms of a movable pad are rotatably connected to the body. In such an example, the portion of the hinge included in the body is integrally formed with and/or from the continuous piece of material that forms the body, as well.

The directional steering tool, in some embodiments, includes a plurality of steering assemblies that each include at least one piston located in a bore (not shown in FIG. 3), where the bore is integrally formed with the body of the directional steering tool. In some embodiments, the piston is movable in a radial direction (either directly radially or angled to a radial direction with a radial component) relative to the rotational axis of the body to urge the movable pad in the radially outward direction. In some embodiments, the piston is coupled or connected to the movable pad to also apply a radially inward force to retract the movable pad. In some embodiments, the piston is not coupled to the movable pad, but rather a separate biasing element (such as a spring in the hinge) applies a biasing force to restore the movable pad radially inward in the absence or reduction of the radially outward force from the piston. In some embodiments, the piston is not coupled to the movable pad, but rather a static pressure in the wellbore and/or contact with a wellbore wall applies a radially inward force to restore the movable pad radially inward in the absence or reduction of the radially outward force from the piston.

In some embodiments according to the present disclosure, a hinge that is at least partially integrally formed with the body and/or a bore that is integrally formed with the body allows the body to be stiffer and/or the movable pad to have a larger range of motion in a radial direction.

In a conventional steering tool, a cavity is formed (either cast or machined) in the outer surface of the body to receive a clamp plate that carries the steering assembly. The large cavity creates a weaker body in torsion (a common force applied to the directional steering tool) that causes the body to flex under load and leak around the edges of the seals of the clamp plate. In some embodiments, an integrally formed hinge allows a portion of the hinge to remain integrally formed with the body and provide additional strength to the body. Further, integrally forming the bore(s) in the body allows the material of the bore walls to remain integrally formed with the body and provide additional strength to the body. Ultimately, this allows the bore to be larger with a longer stroke and larger range of motion for the movable pad. In some embodiments, a hinge that is partially integrally formed with the body allows a hinge pin to be located through a portion of the body and a portion of the movable pad providing additional strength to the body and limiting relative movement of the body and the movable pad (which can produce binding) during torsional flexion of the steering tool.

In some embodiments, the bore is integrally formed in the body, and the body material is not a desired material for the bore wall. In such embodiments, the bore has a sleeve positioned therein, wherein the sleeve includes or is made of a different material from the bore. In some embodiments, the sleeve is or includes the same material but machined to a higher tolerance than the bore is formed in the body. In some embodiments, the sleeve includes or is made of a harder and/or tougher material than the body material to withstand the wear and/or erosion of the piston and a piston fluid repeatedly moving in the sleeve. In some embodiments, the piston includes or is made of a piston material that is metallurgically incompatible with the body material (such as polycrystalline diamond piston and a steel body), and the sleeve.

In some embodiments, bore has a substantially constant inner diameter along the length of the bore, and the sleeve has a substantially uniform sleeve thickness along the length of the sleeve. In some embodiments, the sleeve is press-fit or friction-fit into the bore. In some embodiments, at least a portion of the bore wall tapers (i.e., an inner diameter of the bore decreases) toward a radially outward end of the bore, and the sleeve has a sleeve thickness that decreases toward the radially outward end of the bore such that an inner diameter of the sleeve is substantially constant along a length of the sleeve. In some embodiments, the body of the steering tool is heated prior to insertion of the sleeve to expand an inner diameter of the bore and heat-shrink the bore to the sleeve after insertion. In some embodiments, the sleeve is cooled (such as via liquid nitrogen) to contract the sleeve prior to insertion of the sleeve, after which the thermal expansion of the sleeve compresses the sleeve against the wall of the bore. In some embodiments, both the body is heated and the sleeve is chilled before insertion of the sleeve in the bore.

In some embodiments, the piston is a substantially spherical piston. In some examples, a spherical piston may limit binding of the piston in the bore and/or sleeve. In some embodiments, a height of the spherical piston above the body at the top of its travel in the bore and/or sleeve is based upon a radius of the piston. As described herein, a bore (and/or a hinge) that is integrally formed with the body allows for a larger bore while the body remains as strong or stronger than a conventional steering tool with a clamp plate assembly. A larger bore diameter allows a larger spherical piston diameter, and a larger spherical piston diameter allows for a greater radial deployment and/or greater range of motion of the movable pad relative to the outer surface of the body.

In some embodiments, a spherical piston diameter is at least 35% of a radius of the body (from the rotational axis to the outer surface). In some embodiments, a spherical piston diameter is at least 45% of a radius of the body. In some embodiments, a spherical piston diameter is at least 50% of a radius of the body. In a non-limiting example, a steering tool with a 4-inch (101.2-mm) radius has at least one spherical piston with a piston diameter of 40 mm. In such embodiments, the range of motion is greater than a conventional steering tool with smaller bore(s) and piston(s).

In some embodiments, the steering tool has integrally formed bores in the body. In some embodiments, the steering tool has a hinge that couples the movable pad to a hinge plate. The hinge plate incorporates a central lug with one or both of a lower kicker and an upper kicker. The hinge plate allows a hinge pin to be inserted into the hinge plate to connect the movable pad to the hinge plate. Upon insertion of the hinge plate into the body of the steering tool, the hinge pin becomes axially captured in the hinge plate. In some embodiments, the integrally formed bores allow the body to maintain a strength and/or rigidity greater than that of a conventional steering tool with a clamp plate, while the hinge plate provides an ease of assembly and/or repair for the hinge.

In some embodiments, the radially outward ends of the bores terminate at a support surface. The support surface is configured to support the movable pad when in a radially inboard position. In some embodiments, the support surface is substantially continuous between the radially outward ends of the bores. For example, a substantially continuous support surface has a substantially constant radius relative to the rotational axis of the steering tool between the radially outward ends of the bores. For example, a substantially continuous support surface is substantially flat and linear in a longitudinal direction of the support surface between the radially outward ends of the bores. In some embodiments, a substantially continuous support surface is monolithic between the radially outward ends of the bores. In some embodiments, a substantially continuous support surface allows for more material between the bores, which provides additional strength and rigidity to the body to reduce flexing relative to the hinge plate.

In some embodiments, at least a portion of the hinge is integrally formed with the body to further strengthen the body. The hinge pin is located through a central lug integrally formed with the body and couples the central lug to the arm(s) of the movable pad together around the hinge pin. In some embodiments, a hinge with a central lug integrally formed with the body includes a discrete lower kicker and/or a discrete upper kicker that are configured to be fastened to the body independently of the hinge. In some embodiments, removal of one or both kickers allows insertion or removal of the hinge pin from the hinge.

In some embodiments, a hinge with a central lug integrally formed with the body includes a hinge hole that allows the hinge pin to be inserted or removed from the body and/or the hinge. For example, the hinge pin may be otherwise entirely captured within the body. The hinge hole may provide axial access to the hinge to connect the movable pad to the body.

In some embodiments, the body has a hinge hole to allow axial access to the hinge pin. In some embodiments, a hinge axis, the hinge hole, and the hinge pin are angled relative to the rotational axis of the steering tool in the radially outward direction. For example, the angled hinge axis allows an angled deployment of the movable pad relative to the outer surface of the body and relative to the rotational axis. In some embodiments, an angled hinge hole relative to the rotational axis of the steering tool allows for a shorter hinge hole compared to a hinge hole that is parallel to the rotational axis. In some examples, a shorter hinge hole facilitates easier assembly and/or disassembly of the hinge pin in the hinge. In some examples, a shorter hinge hole may reduce erosion in the hinge hole.

In some embodiments, the body of the steering tool tapers in an uphole direction. For example, the outer diameter of the outer surface of the body decreases in the uphole direction of the steering tool away from the movable pad. In some examples, the tapered body reduces the likelihood of contact with the borehole wall and provides additional clearance. In some examples, the tapered body reduces a rigidity of the body, rendering additional strength from the integrally formed hinge and/or bores of embodiments of the steering assemblies described herein even more important to the steering tool.

In some embodiments, a hinge pin includes a plurality of segments. In some embodiments, a segmented hinge pin is modular, allowing segments to be used across multiple steering assembly designs and/or steering tool designs. In some embodiments, a segmented hinge pin is modular, allowing different segments to be replaced individually. In some embodiments, a segmented hinge pin reduces the friction and/or binding of each segment to the hinge bore (e.g., the bore through the movable pad and the body or hinge plate). Segments of shorter length may, therefore, require less force to insert or remove.

In some embodiments, a segmented hinge pin allows individual segments to be inserted individually, reducing the necessary clearance on either end of the hinge bore in the body. In some embodiments, the segmented hinge pin includes at least one axle segment that spans the arm of the movable pad and at least one spacer segment that positions the at least one axle segment in the hinge bore. The segmented hinge pin, in some embodiments, further includes a pin cap that seals and retains the other segments in the hinge bore.

In some embodiments, at least one of the segments of the segmented hinge pin includes an axial fastening interface. The axial fastening interface allows a tool to be inserted axially into the segment and pulled from the hinge bore. For example, an axial fastening interface may include a threaded interface that allows an operator to thread a tool into the axial fastening interface and pull the segment from the hinge bore. In some embodiments, at least one segment includes a through bore that allows a tool to pass through the segment and access the axial fastening interface of an adjacent segment.

In some embodiments, the segmented hinge pin includes substantially cylindrical segments and pin cap. In some embodiments, the hinge pin includes non-cylindrical segments. For example, a segmented hinge pin may include spherical axle segments. In some examples, spherical axle segments are anchored by non-spherical segments and/or cylindrical segments. In some embodiments, the spacer segments are made of or include a different material than the axle segments. For example, the axle segments may be made of or include a stronger material than the spacer segments. In some embodiments, the axle segments have a greater thickness or a smaller bore, such that the axle segments are stronger than the spacer segments.

In at least some embodiments according to the present disclosure, an integrally formed hinge and/or an integrally formed bore allows an increased amount of material in the body of the steering tool relative to a conventional steering tool with a clamp plate steering assembly. In some embodiments, a thickness of the body between a central flow bore and a bore of the steering assembly is increased relative to a conventional central flow bore design to further strengthen the body and prevent cracking or erosion between the components.

In some embodiments, a steering tool with a non-circular central flow bore allows for a thicker portion of the body between the radially inward end of the bore(s) of the steering assembly(ies) relative to a conventional circular flow bore and/or a larger cross-sectional area of the central flow bore. A non-circular central flow bore may, therefore, reduce erosion-induced cracking between the central flow bore and the steering assemblies.

In some embodiments, the non-circular central flow bore has a portion with a minimum radius and a portion with a maximum radius. In some embodiments, the non-circular central flow bore is co-axial with the rotational axis of the steering tool, and the minimum radius and the maximum radius are measured from the rotational axis. In some embodiments, the non-circular central flow bore is not co-axial with the rotational axis of the steering tool, and the minimum radius and the maximum radius are measured from a center axis of the non-circular central flow bore.

In some embodiments, a non-circular central flow bore has a plurality of minimum radii at different orientations around the central axis of the non-circular central flow bore.

For example, the non-circular central flow bore may have a plurality of minimum radii of equal lengths at different orientations around the central axis of the non-circular central flow bore. For example, the non-circular central flow bore may have a plurality of local minimum radii of different lengths at different orientations around the central axis of the non-circular central flow bore. In some embodiments, a non-circular central flow bore has a plurality of maximum radii at different orientations around the central axis of the non-circular central flow bore. For example, the non-circular central flow bore may have a plurality of maximum radii of equal lengths at different orientations around the central axis of the non-circular central flow bore. For example, the non-circular central flow bore may have a plurality of local maximum radii of different lengths at different orientations around the central axis of the non-circular central flow bore.

In some embodiments, the minimum radius is angularly oriented toward a steering assembly and/or a radially inward end of the bore of the steering assembly. In some embodiments, the minimum radius is directed at a flat portion of the cross-sectional shape of the non-circular central flow bore. In some embodiments, the maximum radius is angularly oriented between two steering assemblies. In some embodiments, the maximum radius is directed at an apex and/or corner of the cross-sectional shape of the non-circular central flow bore.

In at least one embodiment, one or more of an integrally formed bore, an integrally formed portion of a hinge, and a non-circular central flow bore allows for a stronger body of a steering tool. The stronger body may allow for a larger bore (in length and/or diameter) and a longer range of motion of a movable pad relative to the body. In some embodiments, the one or more of an integrally formed bore, an integrally formed portion of a hinge, and a non-circular central flow bore reduces cracking and/or erosion of the body, further increasing an operational lifetime of the steering tool.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A device for steering a downhole tool, the device comprising:

a body having a rotational axis;

a steering pad, the steering pad being movable radially outward relative to the body at a hinge, the hinge including:

a central lug integrally formed with the body;

an arm of the steering pad; and a hinge pin extending through the central lug integrally formed with the body and through the arm of the steering pad;

a bore integrally formed in the body from a single piece of material of the body, the bore having a bore longitudinal axis that is at least partially radially relative to the rotational axis of the body, and the bore further having an inner diameter that tapers along at least 25% of the bore longitudinal axis toward a radially outward end of the bore; and a piston in the bore and movable in the bore to apply a radially outward force to the steering pad.

2. The device of claim 1, wherein the body has a body radius from the rotational axis to a radially outward portion of the body, and the piston has a diameter no less than 35% of the body radius.

3. The device of claim 1, wherein the body further includes a central flow bore in an axial direction of the rotational axis, the central flow bore having a transverse cross-section that is non-circular.

4. The device of claim 3, wherein the transverse cross-section has at least one flat portion.

5. The device of claim 3, wherein a minimum radius of the transverse cross-section is proximate to a radially inward end of the bore.

6. The device of claim 1, further comprising an upper kicker and a lower kicker coupled to the body.

7. The device of claim 1, wherein the hinge pin is a segmented hinge pin including at least one non-cylindrical segment.

8. The device of claim 1, wherein the piston is a spherical piston.

9. The device of claim 1, wherein a hinge axis of the hinge is angled relative to an axial direction of the body in a radial direction relative to the rotational axis.

10. The device of claim 9, wherein the hinge pin includes a plurality of segments.

11. The device of claim 10, wherein at least one segment of the plurality of segments of the hinge pin includes an axial fastening interface.

12. The device of claim 11, wherein the axial fastening interface is threading.

13. The device of claim 1, wherein the body is tapered in an uphole direction.

14. A device for steering a downhole tool, the device comprising:

a body having a rotational axis;

a steering pad, the steering pad being movable radially outward relative to the body at a hinge;

a bore being integrally formed in the body from a single piece of material of the body, the bore comprising:

a circular cross-section;

a bore longitudinal axis that is at least partially radially relative to the rotational axis of the body; and a hemispherical base at a radially inward end of the bore;

a cylindrical sleeve positioned in the bore between a piston and an inner wall of the bore; and the piston is positioned in the sleeve and movable in the sleeve to apply a radially outward force to the steering pad, wherein the piston and sleeve are configured to receive a piston fluid therebetween and contacting the piston and the sleeve.

15. The device of claim 14, wherein the sleeve has a thickness that changes in a longitudinal direction of the bore longitudinal axis.

16. The device of claim 14, wherein the hinge includes:

a central lug integrally formed with the body, an arm of the steering pad, and a hinge pin located through the central lug integrally formed with the body and through the arm of the steering pad.

17. The device of claim 14, wherein the sleeve includes a different material from the body.

18. A device for steering a downhole tool, the device comprising:

a body having a rotational axis and a body radius, the body radius extending from the rotational axis to a radially outward portion of the body;

a steering pad, the steering pad being movable radially outward relative to the body at a hinge, the hinge including:

a central lug integrally formed with the body;

an arm of the steering pad; and a hinge pin extending through the central lug integrally formed with the body and through the arm of the steering pad;

a bore integrally formed in the body from a single piece of material of the body, the bore having a bore longitudinal axis that is at least partially radially relative to the rotational axis of the body; and a piston in the bore and movable in the bore to apply a radially outward force to the steering pad, the piston having a diameter no less than 35% of the body radius.

19. The device of claim 18, wherein the body further includes a central flow bore in an axial direction of the rotational axis, the central flow bore having a transverse cross-section that is non-circular.

20. The device of claim 19, wherein the transverse cross-section has at least one flat portion.

* * * * *